US009293289B2

(12) United States Patent
Chen et al.

(10) Patent No.: US 9,293,289 B2
(45) Date of Patent: Mar. 22, 2016

(54) SERVICE DISCONNECT COVER WITH FUSE/TERMINAL RETENTION

(71) Applicant: Yazaki North American, Inc., Canton, MI (US)

(72) Inventors: Haijun Chen, Shanghai (CN); Richard J. Exenberger, Plymouth, MI (US); John J. Hasija, Saline, MI (US)

(73) Assignee: Yazaki North America, Inc., Canton, MI (US)

( * ) Notice: Subject to any disclaimer, the term of this patent is extended or adjusted under 35 U.S.C. 154(b) by 610 days.

(21) Appl. No.: 13/656,804

(22) Filed: Oct. 22, 2012

(65) Prior Publication Data

US 2013/0043971 A1 Feb. 21, 2013

(51) Int. Cl.
*H01H 85/25* (2006.01)
*H01H 85/20* (2006.01)

(52) U.S. Cl.
CPC ..... *H01H 85/2045* (2013.01); *H01H 85/2035* (2013.01); *H01H 85/25* (2013.01); *Y10T 29/49117* (2015.01)

(58) Field of Classification Search
CPC ..... H01H 85/2045; H01H 85/25; H01H 85/2035; Y10T 29/49117
USPC ..... 337/205, 255, 187, 194; 361/835, 837
See application file for complete search history.

(56) References Cited

U.S. PATENT DOCUMENTS

| | | | | | |
|---|---|---|---|---|---|
| 4,544,907 | A | | 10/1985 | Takano | |
| D298,123 | S | * | 10/1988 | Beard | D13/161 |
| 5,294,906 | A | | 3/1994 | Totsuka et al. | |
| 5,739,739 | A | | 4/1998 | Muramatsu et al. | |
| 5,825,274 | A | * | 10/1998 | Totsuka | 337/190 |
| 5,886,612 | A | * | 3/1999 | Beckert et al. | 337/197 |
| 5,929,739 | A | * | 7/1999 | Totsuka | 337/198 |
| 6,054,915 | A | * | 4/2000 | Rowton et al. | 337/216 |
| 7,740,504 | B2 | | 6/2010 | Chikamatsu et al. | |
| 7,948,353 | B2 | * | 5/2011 | Deno et al. | 337/205 |
| 8,007,313 | B2 | | 8/2011 | Deno et al. | |
| 2008/0242150 | A1 | * | 10/2008 | Chikamatsu et al. | 439/620.3 |

* cited by examiner

*Primary Examiner* — Anatoly Vortman
(74) *Attorney, Agent, or Firm* — Harness, Dickey & Pierce, P.L.C.

(57) ABSTRACT

An assembly in which a housing and cover enclose an electric component and lock the electric component into place is provided. The electric component has two L-shaped terminals with notches formed in them that provide lock surfaces for the housing body. The housing body has locking arms that flex during installation and lock the electric component into place by mating with the lock surfaces. The cover body has bosses which push down upon the electric component during installation and lock pins which lock the flexible locking arms into place. The lock pins occupy the space between the locking arms and the backstops of the housing body thereby preventing the locking arms from moving out of position and disengaging the lock surfaces of the locking arms and terminals.

13 Claims, 4 Drawing Sheets

60
54
14
56
56
60
48
50
54
52
16
62
66
68
70
74
72
30
12
32
28

SERVICE DISCONNECT COVER WITH FUSE/TERMINAL RETENTION

FIELD

The present disclosure relates to a service disconnect cover with fuse/terminal retention.

BACKGROUND

The present invention relates to a fuse, an electric component used to open a circuit when the current in the circuit exceeds a predetermined value. Fuses are commonly used as a service disconnect in electric automobiles, protecting maintenance work when an electric system of the vehicle is being checked and maintained. While U.S. Pat. No. 7,740,504 discloses one such fuse that is locked into its housing. Such fuses can be difficult to assemble and may require special tools for assembly.

It would be desirable to provide a service disconnect assembly that not only locks the fuse into place but provides a backup to assure the integrity of those locks. It would also be desirable to provide an easily assembled service disconnect assembly that does not require special tools for assembly.

SUMMARY

This section provides a general summary of the disclosure, and is not a comprehensive disclosure of its full scope or all of its features.

In one example of the present disclosure, the assembly can include an electric component having an electric component body and a pair of terminals, each of the terminals having a lock surface; a housing having a housing body with backstops and locking arms, each of the locking arms having a body lock surface that mates with an associated lock surface of the terminals; and a cover having a pair of lock pins that push the locking arms into place so that the body lock surfaces of the locking arms mate with the lock surfaces of the terminals. The locking arms can include a fixed end fixed to the housing body and a free end movable relative to the housing body, with the body lock surface on the free end. The lock pins can be positioned between the free ends of the locking arms and an associated backstop of the housing body to inhibit the body lock surfaces of the free ends from disengaging from the lock surfaces of the terminals. The lock pins and locking arms can each have a chamfer, the lock pin chamfer making contact with an associated locking arm chamfer and aligning the electric component, cover, and housing.

The terminals can be L-shaped blade terminals that can have a notch at a bend of the "L" to provide lock surfaces to mate with the associated body lock surfaces of the locking arms. The lock surfaces can also be located on a shoulder of the terminals between the bends of the terminals and where the terminals enter the electric component body. The electric component within the electric component body can be a fuse, fusible link, relay, busbar assembly, busbar shunt or 90 degree terminal. The cover can have a lip around the edge of the cover that is received by a recess in the housing body to create a labyrinth between a cavity of the housing body and the outside environment and/or to aid in stabilizing the assembly.

In another example of the present disclosure, the assembly can include an electric component with a lock surface, a housing body with locking arms that can be flexed from an original position to enable a locking mechanism, and a cover with lock pins that prevent the locking arms from flexing from the original position. The lock pins can occupy a space between the locking arms and an associated backstop of the housing body wherein the gaps between the locking arms, lock pins, and the backstops are too small to allow the locking arms to disengage from the lock surfaces. The electric component can also have a pair of terminals, each of the terminals having a lock surface that can be engaged by a locking arm.

In another example of the present disclosure, a method can include an electric component having terminals, a housing having backstops and locking arms, and a cover having lock pins and bosses wherein the bosses are fitted onto the terminals and a force is exerted on the cover and transmitted through the bosses to the terminals to push the electric component into the housing. The bosses and the electric component can cooperate to align the cover to the housing. The locking arms can be fixed to the housing at a fixed end, the opposite, free end being free to flex about that fixed end and having a first and second chamfer. The second chamfer can contact the terminals during insertion of the electric component and cover, and the first chamfer can contact the lock pins during insertion of the same. The force exerted on the cover and transmitted to the terminals can be transmitted to the second chamfer of the locking arms, moving the free ends toward an associated backstop of the housing. As the terminals slide past the free ends of the locking arms, the force exerted on the cover and transmitted to the lock pins can be transmitted to the first chamfer of the locking arms, forcing the locking arm to move toward the terminals. The lock pin can occupy the space between the free end of the locking arm and the backstop of the housing cover, inhibiting the free end from disengaging from the terminal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected examples and not all possible implementations, and are not intended to limit the scope of the present disclosure.

Corresponding reference numerals indicate corresponding parts throughout the several views of the drawings.

DETAILED DESCRIPTION

Figure 1:
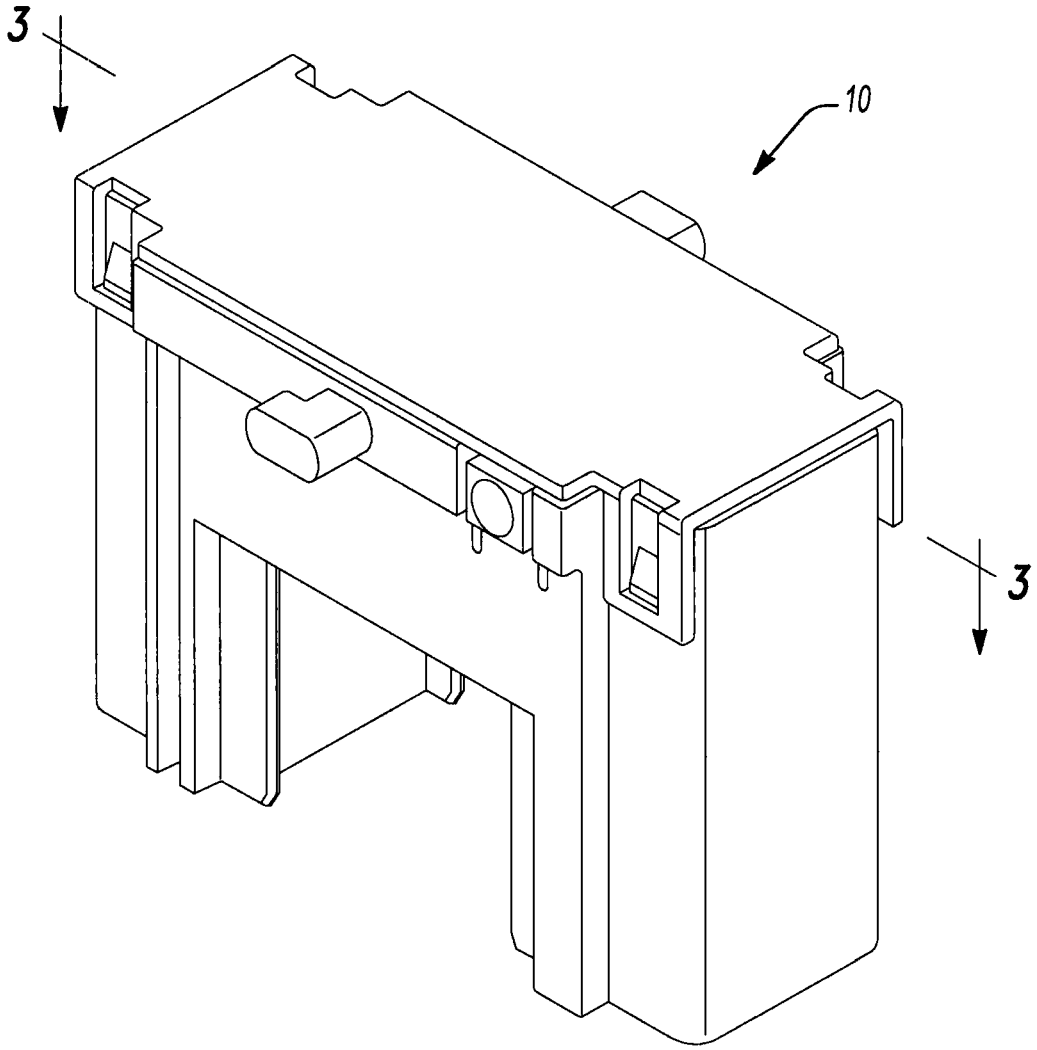
FIG. 1 is a perspective view of an assembly constructed in accordance with the teachings of the present disclosure.
Figure 2:
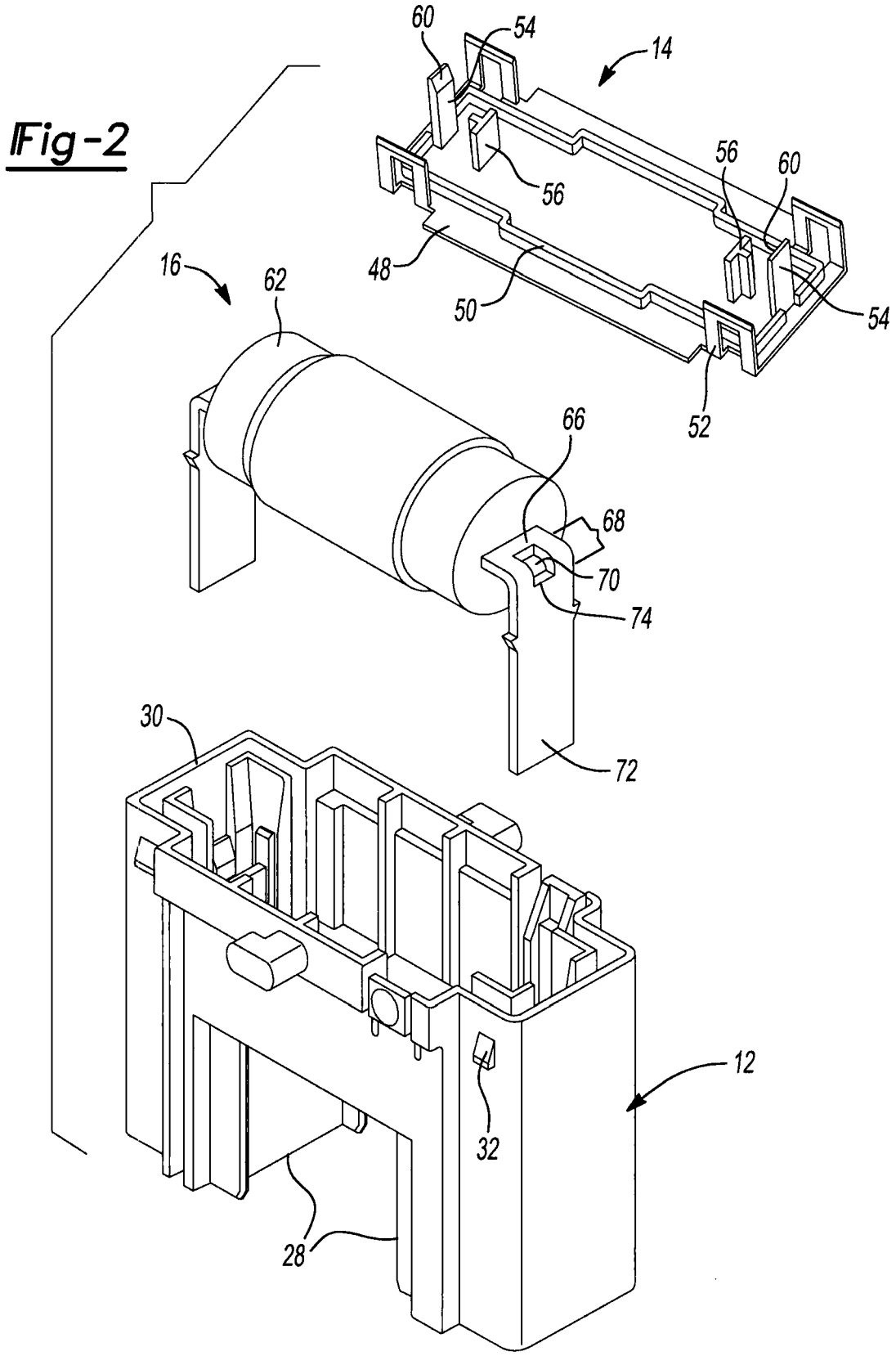
FIG. 2 is an exploded perspective view of the assembly of FIG. 1 wherein the bottom of the cover is exposed to show detail.

With reference to FIGS. 1 and 2 of the drawings, an exemplary assembly constructed in accordance with the teachings of the present disclosure is generally indicated by reference numeral 10. The assembly 10 can comprise a housing 12, a cover 14, and an electric component 16.

Figure 4:
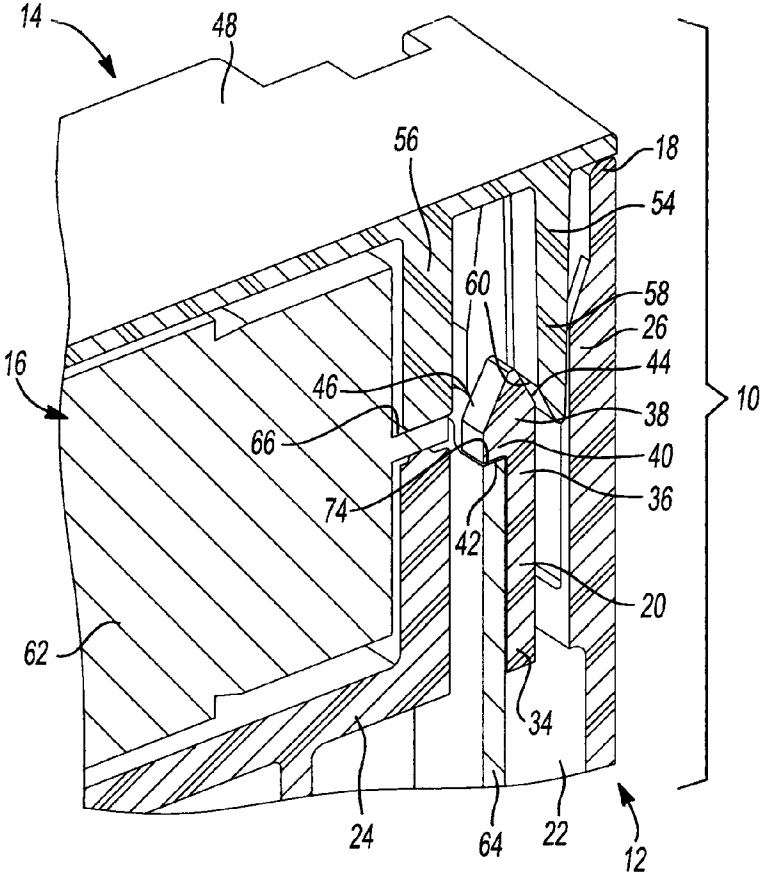
FIG. 4 is a portion of a cross sectional perspective view taken along line 3-3 of FIG. 1.
Figure 3:
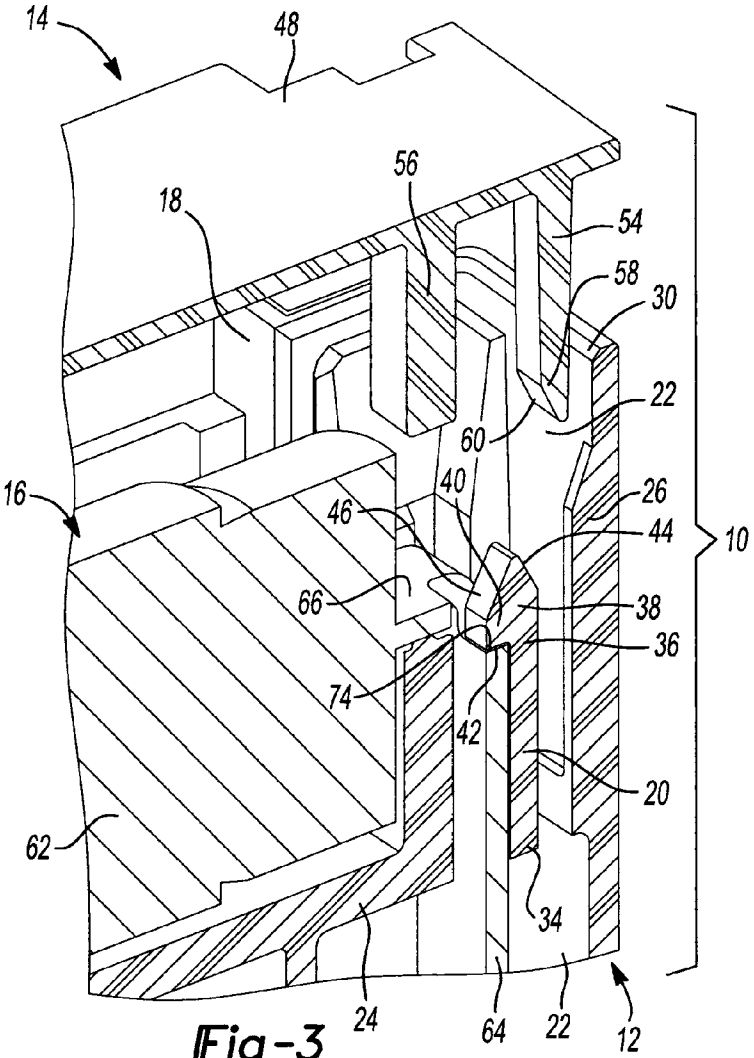
FIG. 3 is a portion of a cross sectional perspective view taken along line 3-3 of FIG. 1 with the cover partly exploded.
Figure 5:
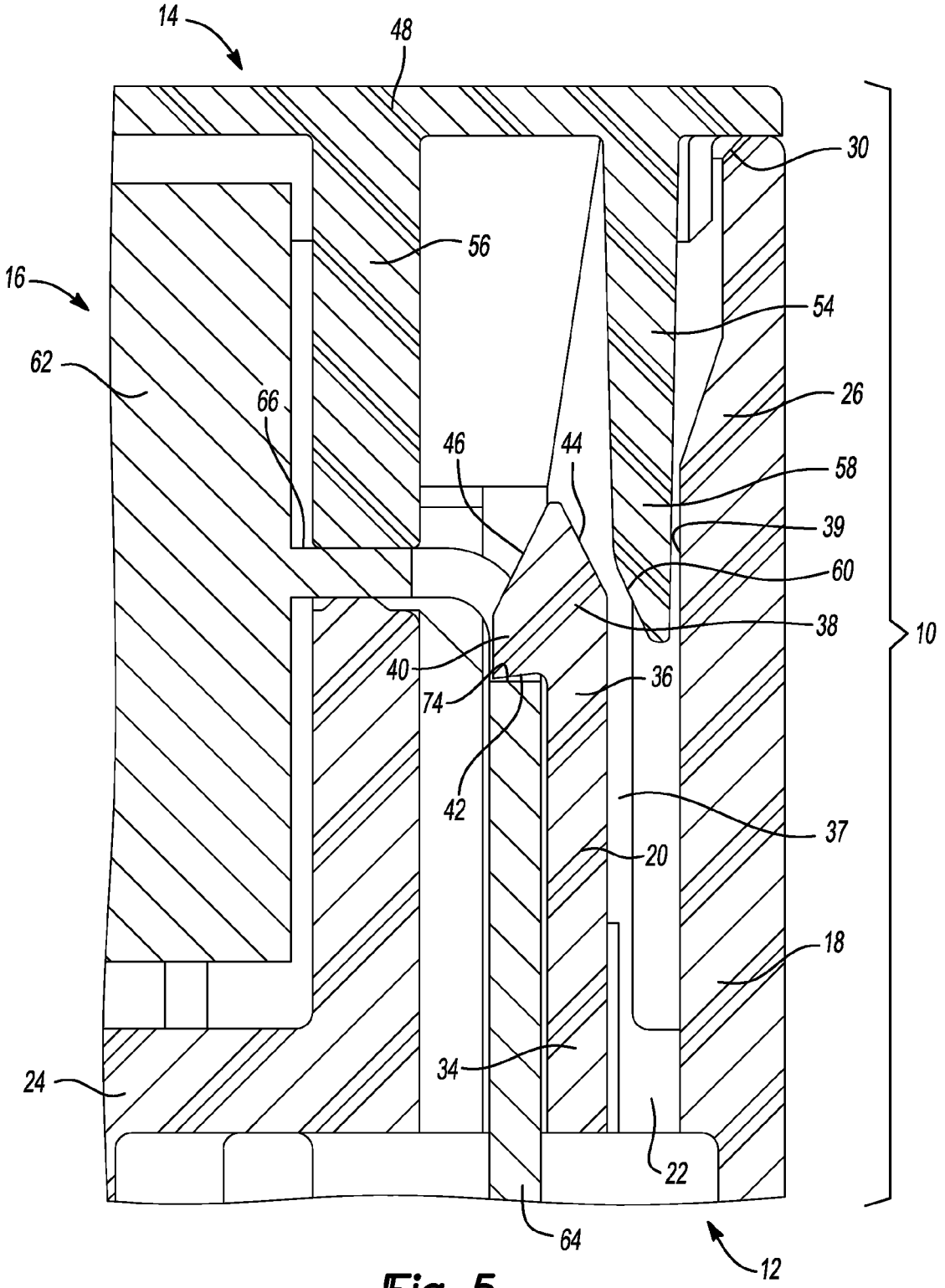
FIG. 5 is portion of a cross sectional view taken along line 3-3 in FIG. 1.

With reference to FIGS. 2 and 3, the housing 12 can have a housing body 18 with a locking arm 20; a cavity 22 to receive the electric component 16; an electric component support 24 to support the electric component 16; a backstop 26; and a pair of apertures 28 to provide access for an electric connection with the electric component 16. The housing body 18 can also have a recess 30 to receive the cover 14 and a nub 32 to lock the cover 14 into place. The locking arm 20 can be fixed to the housing body 18 at a fixed end 34 and free at an opposite free end 36 that is flexible about the fixed end 34. The free end 36 may be in a first position seen in FIGS. 3-5 or in a second position where the free end 36 is flexed toward the backstop 26. The free end 36 can have a locking element 38 to lock the electric component 16 into place. In the example provided, the locking element 38 includes a barb 40 having a body lock surface 42, and a first chamfer 44 and second chamfer 46.

The cover 14 can have a cover body 48 with a lip 50 to fit into the housing 12, a locking tab 52 to lock the cover 14 onto the housing 12, and a pair of lock pins 54 and a pair of bosses 56 that extend from the cover body 48 toward the housing 12. The lock pins 54 can have a distal end 58 that has a lock pin chamfer 60.

The electric component 16 can be any type of electric device or circuit and can have an electric component body 62 and a pair of terminals 64. In the particular example provided the electric component 16 is a fuse. It will be appreciated however that the teachings of the present disclosure have broader applicability. For example, the electric component 16 could be a relay, busbar assembly, busbar shunt or 90 degree terminal.

Each of the terminals 64 can be L-shaped with a shoulder 66, a bend 68, a notch 70 with a lock surface 74, and a connection end 72. The shoulder 66 is the area of the terminal 64 between the bend 68 and where the terminal 64 enters the electric component body 62. The connection end 72 is the area of the terminal 64 between the bend 68 and where the terminal 64 makes an electric connection with a circuit (not shown). In the particular example provided, the bends 68 are such that the shoulders 66 and the connection ends 72 are at a right angle with one another. The notch 70 is a hole through the terminal 64 that can create a lock surface 74 oriented to mate with the body lock surface 42 such that the mating inhibits withdrawal of the electric component 16 from the housing 12. According to the teachings of the present disclosure, the notch 70 is in the bend 68 and the lock surface 74 is created by the notch 70. In other examples of the present disclosure the lock surface 74 can be the shoulder 66, a feature of the electric component body 62, or anywhere on the electric component 16.

To assemble the assembly 10, the electric component 16 can be aligned to the housing 12 and the cover 14 such that the connection ends 72 of the terminals 64 are received into the apertures 28 and the bosses 56 are abutted against a portion of the electric component 16, such as the shoulders 66. As force is applied to the back of the cover 14 and transmitted to the electric component 16 through the bosses 56, the connection ends 72 make contact with the second chamfers 46 of the locking arms 20. Force is transmitted from the connection ends 72 through the second chamfers 46 to move the free ends 36 from the first position into the second position and permit the connection ends 72 to slide by the free ends 36. In the second position, one edge of each of the body lock surfaces 42 is in contact with the terminals 64. The connection ends 72 continue to slide past the free ends 36 until the free ends 36 reach the notches 70 and move back into the first position, mating the body lock surfaces 42 with the lock surfaces 74.

As the cover 14 pushes down on the electric component 16 and the connection ends 72 move past the free ends 36, the lock pins 54 make contact with the free ends 36. The lock pin chamfers 60 contact the first chamfers 44 so that the lock pins 54 transmit force from the cover body 48 to the first chamfers 44, thus forcing the barbs 40 of the free ends 36 into the notches 70, mating the body lock surfaces 42 with the lock surfaces 74. It should also be noted that there may be resistive force from the terminals 64 through the free ends 36 that pushes back upon the lock pins 54. The backstop 26 is positioned such that the lock pin 54 would make contact with the backstop 26 which would provide a counteractive force, forcing the free ends 36 into the first position. The size of each gap 37, 39 (FIG. 5) between the free end 36, the lock pin 54 and the backstop 26 is too small to allow the body lock surface 42 of the free end 36 of the locking arm 20 to disengage from the lock surface 74 of the electric component 16.

The cover body lip 50 is received by a recess 30 of the housing body 18 to create a labyrinth between the cover body lip 50 and recess 30 that assists in excluding dirt, moisture and other contaminants from the cavity 22. The tabs 52 on the cover body 48 fit over the nubs 32 on the housing body 18 to lock the cover 14 into place, which aids in stabilizing the assembly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An assembly comprising:

an electric component having a pair of terminals each of the terminals having a lock surface;

a housing having a housing body with backstops and locking arms, each of the locking arms having a fixed end fixed to the housing body and a free end that is movable relative to the housing body, the free end having a body lock surface that locks onto the lock surface of an associated one of the terminals when the electric component is fully inserted into the housing; and a cover coupled to the housing, the cover having a cover body, a pair of bosses extending from the cover body, and a pair of lock pins that extending from the cover body, the pair of bosses disposed between the lock pins, each boss abutting a shoulder of a corresponding one of the terminals such that a force applied to the cover is transmitted to the terminals, each of the lock pins being received between the backstops and an associated one of the free ends to thereby inhibit movement of the associated one of the free ends in a direction that permits the associated one of the free ends from disengaging its associated lock surface.

2. The assembly of claim 1 wherein the electric component, the housing, and the cover cooperate to align the cover to the housing.

3. The assembly of claim 2 wherein each of the lock pins has a distal end that is disposed on a side opposite to the cover body, each of the distal ends having a lock pin chamfer.

4. The assembly of claim 3 wherein each locking arm has a locking arm chamfer engaging the lock pin chamfer when the cover body is placed on the housing body and the lock surface of the locking arm is not engaged with the locking surface of the terminal.

5. The assembly of claim 1 wherein the terminals are blade terminals that comprise a generally L-shaped portion with a bend in a middle section of the terminal such that faces on either end of the bend are at a right angle with one another.

6. The assembly of claim 5 wherein each of the L-shaped portions has an apex, wherein a notch is formed in each apex and wherein each notch has a set of interior faces.

7. The assembly of claim 6 wherein the lock surface of the terminal is one of the interior faces of the notch.

8. The assembly of claim 5 wherein the electric component has an electric component body, and wherein the lock surface of the terminal is located on a shoulder between the bend and the electric component body.

9. The assembly of claim 1 wherein the electric component is a fuse, fusible link, relay, busbar assembly, busbar shunt or 90 degree terminal.

10. The assembly of claim 1 wherein the cover body has a cover body lip near the periphery of the cover body extending toward the housing body and the housing body has a recess to accommodate the cover body lip.

11. An assembly comprising:

an electric component having a lock surface;

a housing having a housing body, backstops, and locking arms, each locking arm being flexible about a fixed end to be displaced from an original position during electric component installation and automatically returned to the original position after the electric component is fully seated in the housing, a free end of the locking arm being opposite the fixed end and having a body lock surface that mates with the lock surface on the electric component such that the mating inhibits withdrawal of the electric component from the housing; and a cover having a cover body, a pair of bosses and lock pins, the pair of bosses disposed between the lock pins, each boss abutting a shoulder of a corresponding terminal of the electric component such that a force applied to the cover is transmitted to the terminals to facilitate insertion of the electric component into the housing, each lock pin extending from the cover body, occupying a space adjacent to the free end of an associated locking arm to prevent the locking arm from flexing from its original position.

12. The assembly of claim 11 wherein each space adjacent to the free end of the locking arm is between the free end of the locking arm and the backstop, the size of each gap between the free end, lock pin, and the housing body being too small to allow the body lock surface of the free end of the locking arm to disengage from the lock surface of the electric component.

13. The assembly of claim 12 wherein the lock surface on the electric component is on the terminals.

* * * * *